United States Patent [19]

Budker et al.

[11] 4,016,499

[45] Apr. 5, 1977

[54] CHARGED PARTICLE ACCELERATOR

[76] Inventors: Gersh Itskovich Budker, ulitsa Maltseva, 6; Vasily Alexandrovich Gaponov, ulitsa Zolotodolinskaya, 9, kv. 27; Boris Mikhailovich Korabelnikov, ulitsa Geroev Truda, 23, kv. 37; Gennady Sergeevich Krainov, ulitsa Tereshkovoi, 40, kv. 32; Sergei Alexandrovich Kuznetsov, ulitsa Lyapidevskogo, 22; Nikolai Konstantinovich Kuksanov, Morskoi prospekt, 15, kv. 9; Vasily Ivanovich Kondratiev, ulitsa Pervomaiskaya, 162, kv. 5; Rustam Abelevich Salimov, Morskoi prospekt, 7, kv. 6, all of Novosibirsk, U.S.S.R.

[22] Filed: July 17, 1975

[21] Appl. No.: 596,750

[52] U.S. Cl. ..... 328/233; 315/57; 313/359

[51] Int. Cl.² ..... H01J 23/00

[58] Field of Search ..... 328/233; 315/57; 313/359

[56] References Cited

UNITED STATES PATENTS

| | | | |
|---|---|---|---|
| 2,820,142 | 1/1958 | Kelliher | 328/233 |
| 3,390,303 | 6/1968 | Abramyan et al. | 315/57 |
| 3,473,064 | 10/1969 | Herb | 313/359 |
| 3,895,254 | 7/1975 | Minamikawa et al. | 315/57 |

*Primary Examiner*—R. V. Rolinec
*Assistant Examiner*—Vincent J. Sunderdick

[57] ABSTRACT

Disclosure is made of a charged particle accelerator comprising a high-voltage generator built around a transformer whose primary winding is arranged coaxially inside a sleeve-like magnetic circuit, the secondary winding of said transformer being a sectional winding. Each coil of the secondary winding is connected to one of seriesly connected diode-capacitor rectifier circuits. An accelerator tube is connected to the high-voltage generator. The accelerator tube and the diode-capacitor rectifier circuits are located within the secondary winding of the transformer. The proposed accelerator is small in size, simple in design and easy to manufacture. It is provided with overvoltage protection means to take care of breakdowns and transient processes.

4 Claims, 3 Drawing Figures

CHARGED PARTICLE ACCELERATOR

The present invention relates to accelerators and, more particularly, to direct-action charged particle accelerators to be used in experimental physics as charged particle sources and, what is more important, in applied fields to irradiate different materials and carry out radiochemical technological processes.

There is known a charged particle accelerator comprising a high-voltage generator built around a transformer having a magnetic circuit with an insulated sectional core, fitted over which are sections (coils) of a secondary winding . Alternating voltage across said secondary winding coils is rectified by means of voltage doubling diode-capacitor rectifier circuits. Said circuits are interconnected in series. High direct voltage is supplied to the high-voltage end of the core and to an accelerator tube, said tube being arranged outside the generator, coaxially with the core. A primary winding is arranged coaxially with the secondary winding, at the internal surface of a sleeve-like yoke of the magnetic circuit. The rectifier circuits are arranged in the spacing between the windings, close to the secondary winding.

This accelerator has a relatively great length due to the sequential arrangement of the high-voltage generator and the accelerator tube. Its magnetic circuit is made up of large-size ferrites of a complicated shape. The core of the magnetic circuit is divided into sections by means of high-voltage dielectric spacers which are difficult to manufacture. In addition, it is not easy to ensure electric contact between said spacers and the ferrite sections. As a result, the manufacture of such magnetic circuits is a serious technological problem. The accelerator tube of the accelerator under review is provided with a high-voltage divider, which accounts for additional manufacturing and power supply costs. The separation of the accelerator tube from the high-voltage generator makes it an extremely difficult task to provide effective means for the protection of the high-voltage elements of the accelerator from overvoltages in cases of breakdowns.

It is an object of the present invention to provide a charged particle accelerator having smaller dimensions, as compared to conventional accelerators.

It is another object of the present invention to provide an accelerator which would be simple in design and easy to manufacture.

It is still another object of the present invention to provide an accelerator having means to protect its elements from overvoltages due to breakdowns and transient processes, which would ensure high reliability of the accelerator and make it possible to use said accelerator at limiting electric field voltages.

The foregoing objects of the present invention are attained by providing a charged particle accelerator comprising a high-voltage generator built around a transformer having a sleeve-like magnetic circuit with a primary winding and a sectional secondary winding being arranged coaxially with said magnetic circuit, thereinside, each coil of said secondary winding being connected to one of diode-capacitor rectifier circuits interconnected in series, said accelerator being further provided with an accelerator tube connected to the generator, in which accelerator the accelerator tube and the diode-capacitor rectifier circuits are arranged, in accordance with the invention, within the space enveloped by the secondary winding of the transformer.

It is expedient that the diode-capacitor rectifier circuits be interconnected via ohmic resistors in order to reduce voltage across the accelerator elements during breakdowns and ensure aperiodic oscillations with absorption of electric energy by said resistors.

It is desirable that the accelerator tube be connected to the diode-capacitor rectifier circuits via ohmic resistors in order to limit the flow of breakdown currents across the accelerator tube and ensure absorption of electric energy by said resistors.

The charged particle accelerator of the present invention has small dimensions due to the fact that the accelerator tube and high-voltage generator are combined in one unit, which is especially important if charged particle are to be accelerated to reach high energies.

The magnetic circuit of the transformer is simple in shape and manufactured from transformer steel. The arrangement of the accelerator tube with the rectifier circuits within the space enveloped by the secondary winding of the transformer makes it possible to provide a common, effective means for protecting all the high-voltage elements of the accelerator from overvoltages due to breakdowns. It is expedient in this connection that in order to reduce still further the size of the accelerator and raise its effectiveness, some of its elements be adapted to perform several functions. Thus, the capacitors of the rectifier circuits also serve as a low-inductance capacitor voltage divider for dividing high voltage through the entire accelerator, which high-voltage divider shows reliable performance at high-frequency oscillations generated due to high-voltage breakdowns. The seriesly connected ohmic resistors account for aperiodic oscillations and a low Q factor of the capacitor divider. The reliable protection of the accelerator from overvoltages makes it possible to operate at limiting electric field intensities that are close to breakdown intensities, which is another factor accounting for the small size of the accelerator.

Other objects and advantages of the present invention will become apparent from the following detailed description of a preferred embodiment thereof taken in conjunction with the accompanying drawings, wherein.

The accelerator of the present invention may be used to accelerate any type of charged particles. The embodiment under review is an accelerator for the acceleration of electrons.

Figure 1:
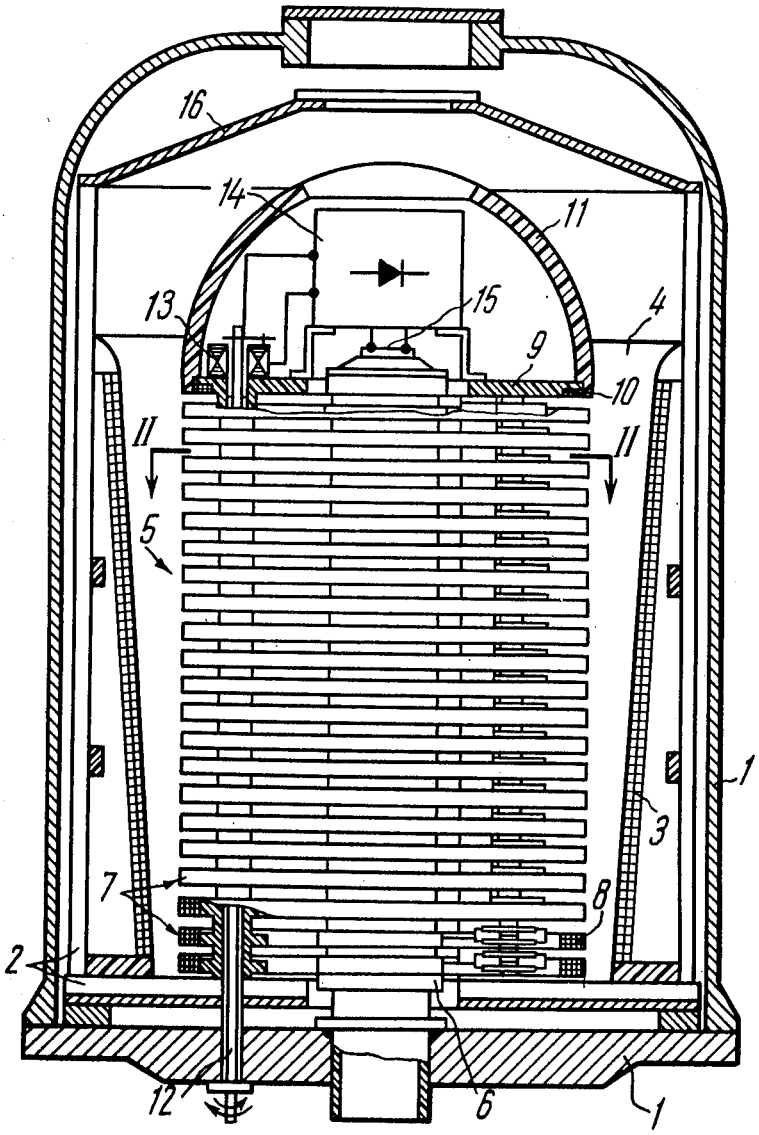
FIG. 1 is a general, longitudinally cut view of a charged particle accelerator in accordance with the invention.

Referring now to the attached drawings, the charged particle accelerator, whose longitudinally cut view is shown in FIG. 1, comprises a shell 1 filled with a compressed gas, which shell houses a sleeve-like magnetic circuit 2 made of transformer steel with radially arranged laminations. Arranged inside the magnetic circuit 2 and coaxially therewith are a conical primary winding 3 with a screen 4, which primary winding 3 is a copper, water-cooled tube extending around the internal surface of the lateral walls of the magnetic circuit 2, and a high-voltage column 5 having an accelerator tube 6 disposed thereinside. The high-voltage column 5 consists of annular sections 7, each of these comprising a coil 8 of the secondary winding of the transformer. At the end of the pile made up of the sections 7 there is a disc 9 carrying a coil 10, and a high-voltage electrode 11. The high-voltage electrode 11 is spherical in shape, made of thin-sheet stainless steel mounted upon a frame of an insulation material, and provided with radial slots for the passage of a varying magnetic flux. The coil 10 is connected to a transformer 13 adjustable with the aid of an insulation roll 12. The transformer 13 is connected to a rectifier unit 14 which, in turn, is connected to an electron gun 15 of the accelerator tube 6. The magnetic circuit 2 is shielded by a metal screen 16.

Figure 2:
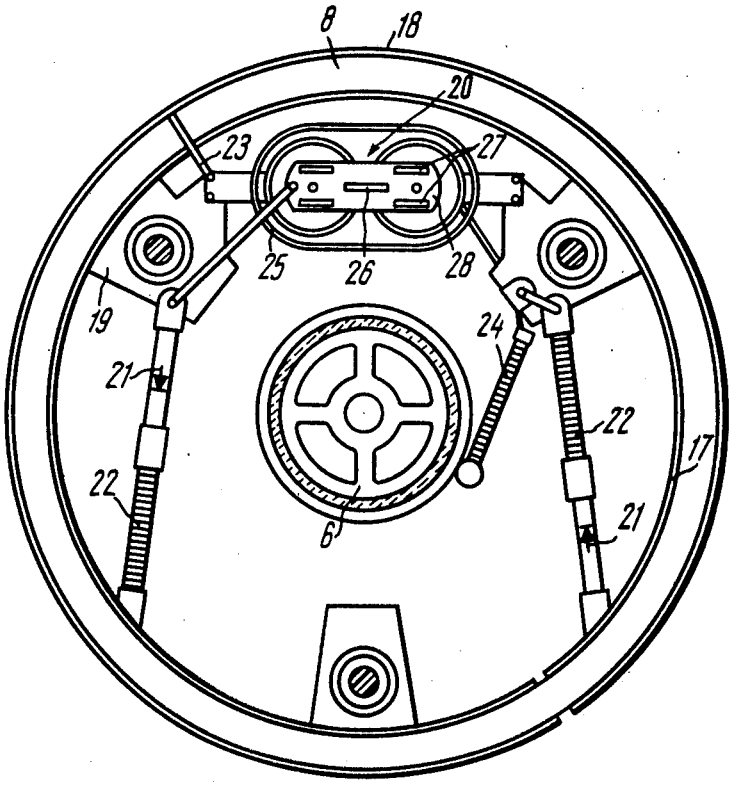
FIG. 2 is a section taken along the line II—II of FIG. 1.

A plan view of one of the sections 7 of the high-voltage column 5 is shown in FIG. 2. The coil 8 is protected on the inside and on the outside by metal screens 17 and 18, respectively. Attached to the inner screen 17 are three legs 19 made of an insulation material. Mounted on said legs 19 is a diode-capacitor rectifier circuit. Said circuit consists of a capacitor unit 20 made up of four ceramic capacitors, said capacitor being interconnected in four ceramic capacitors, said capacitor being interconnected in parallel-series, and of two diode couplers 21 which connect the input and output of the capacitor unit 20 to one of the leads of the coil 8 connected to the screen 17 via chokes 22. A second lead of the coil 8, connected to the outer screen 18, is coupled via a conductor 23 to the center tap of the capacitor unit 20. The rectifier circuit is connected to the accelerator tube 6 via an ohmic resistor 24. The capacitor unit 20 is screened from the varying magnetic flux by an oval-shaped copper ring 25.

The sections 7 which make up the high-voltage column 5 (FIG. 1) are electrically connected to the capacitor units 20 (FIG. 2) by means of spring contacts 26 via four ohmic resistors 27 that are mounted on a board 28 and connected in parallel. The result is a low-inductance, low Q-factor capacitor divider extending along the entire accelerator, which divider rules out the possibility of overvoltages across the elements of the accelerator due to a breakdown in the accelerator tube 6 or in the gas.

The rectifier circuits may be connected to the accelerator tube 6 and interconnected directly, without the ohmic resistors 24 and 27. Yet is highly desirable that such dissipation protective elements be present in the circuitry. (At low voltages /up to 500 kV/ across the tube and with a proviso that the tube has a divider, it is not necessary that the tube be connected to the rectifier circuits).

Figure 3:
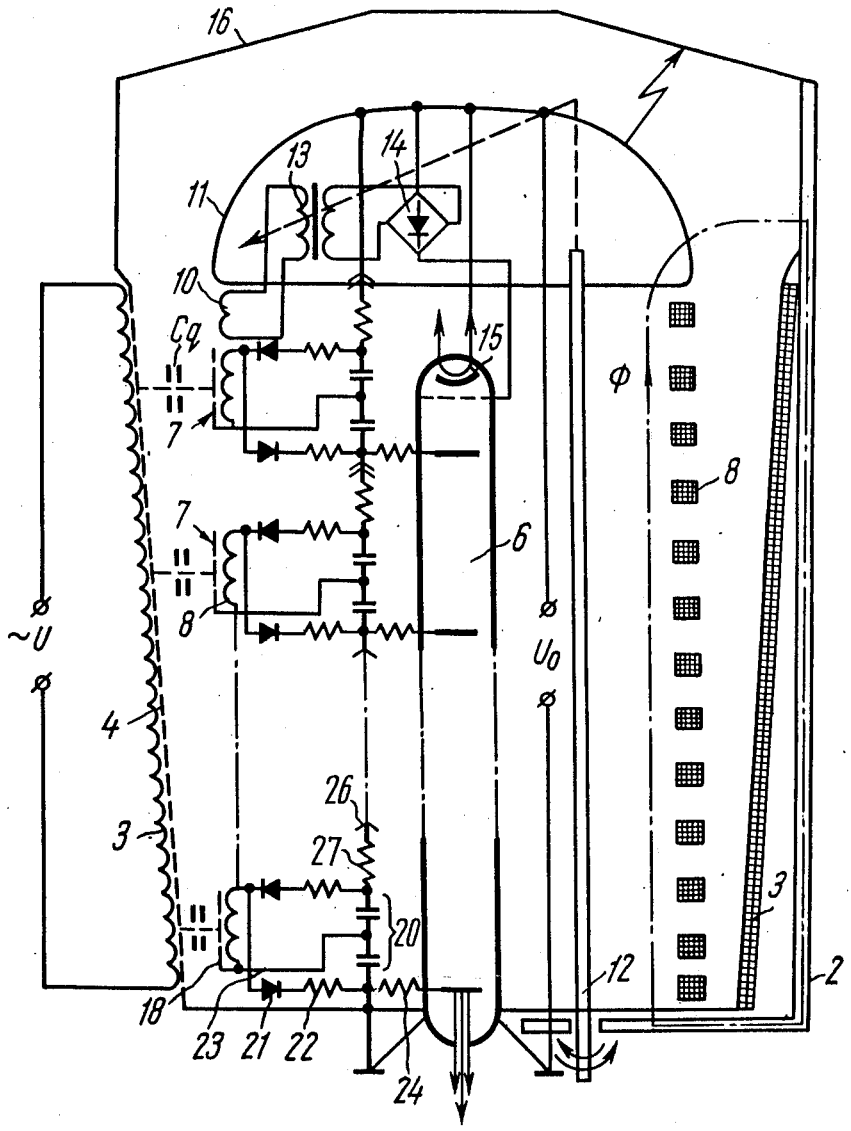
FIG. 3 is a key diagram of the proposed accelerator.

The key diagram of the proposed charged particle accelerator is shown in FIG. 3. A source of alternating voltage U is connected to the primary winding 3 of the transformer which has inductive coupling, by means of the magnetic flux $\phi$ shorted along the magnetic circuit 2, to the coils 8 of the secondary winding. The coils 8 are connected via the diode couplers 21, the chokes 22 and the conductors 23 to the capacitor units 20 which are interconnected in series via the ohmic resistors 27 and the contacts 26. One end of the chain of rectifier circuits is grounded, whereas the other is connected to the high-voltage electrode 11. The supply coil 10 of the electron gun 15 is connnected to the adjustable transformer 13, the latter being connected to the rectifier unit 14. The foregoing portion of the electric circuitry of the accelerator makes up a high-voltage generator. In its center, in the space enveloped by the secondary winding, there is disposed the sectional accelerator tube 6 with the electron gun 15, which tube 6 is connected on one side to the high-voltage electrode 11 of the generator and on the other, via the ohmic resistors 24, to the capacitor divider made up of the capacitors of the units 20 of the diode-capacitor rectifier circuits which are also arranged in the space surrounded by the secondary winding.

The charged particle accelerator of the present invention operates as follows.

The source of alternating voltage U of an increased frequency (normally between 400 and 250 Hz) produces, with the aid of the primary winding 3 of the transformer, a varying magnetic flux $\phi$. The magnetic flux $\phi$ permeates the coils 8 of the secondary winding and induces therein alternating voltage which is rectified by doubling the voltage with the aid of diode couplers 21 and the capacitor units 20. The high voltage $U_o$ thus generated is supplied from the output of the chain of the diode-capacitor rectifier circuits to the accelerator tube 6. The coil 10, wherein alternating voltage is induced by means of the common magnetic flux $\phi$ ensures the feeding of the electron gun 15 via the adjustable transformer 13 and the rectifier unit 14. The electron gun 15 emits electrons to the accelerator tube 6, wherein the electrons are accelerated by the voltage $U_o$ supplied to said tube. The accelerated electrons are then directed to a working substance or a detector, as required.

Breakdown overvoltages are eliminated due to the presence of the capacitor units 20 and the ohmic resistors 27. In the chain of the diode-capacitor rectifier circuits, the capacitor units 20 perform their main functions of doubling the alternating voltage and filtering the rectified current; at the same time they form, together with the ohmic resistors 27, a low-inductance, low Q-factor capacitor divider which protects the accelerator from overvoltages due to breakdowns. The total high-voltage capacitance of this divider is greater than the total spurious capacitance $\epsilon Cq$ (FIG. 3). The presence in the capacitor divider of the ohmic resistors 27 accounts for a low Q-factor of the divider. As a result, oscillations due to breakdowns in the accelerator acquire an aperiodic nature. The energy accumulated in the electric fields of the accelerator is absorbed during a breakdown pulse by the same resistors 27. The total resistance $\epsilon R$ of all the resistors 27 is roughly equal to the wave impedance of the circuit made up of the capacitor divider and the side (spurious) capacitors Cq:

$$\Sigma R \approx \sqrt{\frac{Lq}{\Sigma Cq}},$$

where Lq is the inductance of the divider made up of the capacitor units 20 and the ohmic resistors 27.

During a breakdown the currents through the diode couplers 21 are limited to a permissible level by the chokes 22. Partial breakdown currents through the accelerator tube 6 are limited by the resistors 24 which simultaneously absorb the eneregy accumulated in the capacitor units 20.

In the proposed accelerator all the elements of the high-voltage column are found in a varying magnetic field. For this reason their material and structure are selected so as to exclude their overheating by Foucault currents. These elements may also be screened from the magnetic flux by short circuits.

What is claimed is:

1. A charged particle accelerator comprising: a high-voltage generator built around a transformer; a magnetic circuit of said transformer, which magnetic circuit is sleeve-shaped; a primary winding of said transformer, arranged coaxially with and inside said magnetic circuit; a secondary, sectional winding of said transformer, arranged coaxially with said primary winding and inside said primary winding; coils making up said secondary winding; a high-voltage electrode of said secondary winding; an accelerator tube connected to said high-voltage electrode and arranged in the space enveloped by said secondary winding, coaxially with said secondary winding; a plurality of diode-capacitor rectifier circuits interconnected in series and arranged in the space between said accelerator tube and said secondary winding; each of said diode-capacitor rectifier circuits being connected to one of said coils of the secondary winding.

2. A charged particle accelerator as claimed in claim 1, wherein said diode-capacitor rectifier circuits are interconnected by means of ohmic resistors.

3. A charged particle accelerator as claimed in claim 1, further comprising an additional ohmic resistor and wherein said diode-capacitor rectifier circuits are connected to said accelerator tube via said additional ohmic resistors.

4. A charged particle accelerator as claimed in claim 2, wherein said diode-capacitor rectifier circuits are connected to said accelerator tube via other ohmic resistors.

* * * * *